United States Patent [19]

Marder et al.

[11] Patent Number: 4,913,746

[45] Date of Patent: Apr. 3, 1990

[54] METHOD OF PRODUCING A ZN-FE GALVANNEAL ON A STEEL SUBSTRATE

[75] Inventors: Arnold R. Marder; Mingyuan Gu, both of Bethlehem, Pa.

[73] Assignee: Lehigh University, Bethlehem, Pa.

[21] Appl. No.: 237,424

[22] Filed: Aug. 29, 1988

[51] Int. Cl.[4] ..... C22F 1/16

[52] U.S. Cl. ..... 148/127; 204/37.1; 427/433

[58] Field of Search ..... 428/659; 148/127; 204/28, 37.1; 427/383.9, 433

[56] References Cited

U.S. PATENT DOCUMENTS

| | | | |
|---|---|---|---|
| 1,565,420 | 12/1925 | Cornell | 148/12 R |
| 3,056,694 | 10/1962 | Mehler et al. | 428/659 |
| 3,322,558 | 5/1967 | Turner, Jr. | 427/224 |
| 4,059,711 | 11/1977 | Mino et al. | 427/310 |
| 4,120,997 | 10/1978 | Franks et al. | 427/367 |
| 4,171,392 | 10/1979 | Sievert et al. | 427/321 |
| 4,252,866 | 2/1981 | Matsudo et al. | 428/659 |
| 4,290,860 | 9/1981 | Matsudo et al. | 204/27 |
| 4,407,899 | 10/1983 | Hara et al. | 428/626 |
| 4,541,903 | 9/1985 | Kyono et al. | 204/28 |
| 4,640,872 | 2/1987 | Irie et al. | 428/659 |

FOREIGN PATENT DOCUMENTS

| | | |
|---|---|---|
| 54-46139 | 4/1979 | Japan . |
| 55-110735 | 8/1980 | Japan . |
| 55-37590 | 9/1980 | Japan . |
| 55-122820 | 9/1980 | Japan . |
| 55-122821 | 9/1980 | Japan . |
| 56-13490 | 2/1981 | Japan . |
| 57-19331 | 2/1982 | Japan . |
| 57-19393 | 2/1982 | Japan . |
| 57-70269 | 4/1982 | Japan . |
| 57-73125 | 5/1982 | Japan . |
| 57-89494 | 6/1982 | Japan . |
| 57-164998 | 10/1982 | Japan . |
| 57-181370 | 11/1982 | Japan . |
| 57-200589 | 12/1982 | Japan . |
| 58-77590 | 5/1983 | Japan . |
| 58-117866 | 7/1983 | Japan . |
| 53-146935 | 12/1983 | Japan . |
| 58-210193 | 12/1983 | Japan . |
| 59-23894 | 2/1984 | Japan . |
| 59-74290 | 4/1984 | Japan . |
| 59-166693 | 9/1984 | Japan . |
| 59-200749 | 11/1984 | Japan . |
| 59-200791 | 11/1984 | Japan . |
| 59-229493 | 12/1984 | Japan . |
| 61-207558 | 9/1986 | Japan . |
| 1224346 | 4/1986 | U.S.S.R. . |

*Primary Examiner*—Robert McDowell

*Attorney, Agent, or Firm*—Oblon, Spivak, McClelland, Maier & Neustadt

[57] ABSTRACT

A process for producing a galvanneal layer on a steel substrate, including forming a Zn-Fe coating having a predetermined Fe content F (wt. %) on the steel substrate; and heat treating the Zn-Fe coating on the substrate from a predetermined starting temperature $T_1$ (°C.) to a predetermined ending temperature $T_2$ (°C.) at a predetermined heating rate R (°C./min.), wherein F, $T_1$, $T_2$, and R are selected so that the following condition is met, $$a.R^2+b.T^2+c.R.F.+d.R.T+e.R+f.T=g$$

where a, b, c, d, e, f and g are predetermined constants, thereby to form a virtually 100% $\delta_1$ phase galvanneal structure. Alternatively, the heat treatment can be preformed until the specimen temperature is just below a minimum temperature of the $\delta_1$ phase stability range at at selected Fe content and heating rate, followed by an isothermal hold for a predetermined time period until transformation to the $\delta_1$ phase occurs.

14 Claims, 2 Drawing Sheets

METHOD OF PRODUCING A ZN-FE GALVANNEAL ON A STEEL SUBSTRATE

BACKGROUND OF THE INVENTION

1. Field of the Invention

This invention relates to a method of producing galvanneal $\delta_1$ Zn-Fe alloy coatings on a steel substrate, and the product thereby formed.

2. Discussion of Background

As described in U.S. Pat. No. 4,640,872 to Irie et al., among surface treated streel strips, zinc coated steel has found the widest variety of applications, for example, in automobiles, electric appliances, building material and the like because of its improved sacrificial corrosion prevention effect. Recently, the need for rust prevention has been increased in some applications and it has been desired to enhance the rust prevention of zinc coated steel. There has been the need for imparting heavy duty rust prevention to zinc coated steel because the rust prevention that current zinc-coated steel possesses is still insufficient in certain applications. More illustratively, zinc coated steel strips have poor phosphatability, paintability, and wet adhesion of paint coating, and deteriorate in corrosion resistance during service at joints such as hemmed joints as often formed in automobile doors whether or not they are coated with paint. A closer attention has been paid to these drawbacks and there is the strong desire to overcome them. Particularly, surface treated steel strips for use in automobiles are required to have improved corrosion resistance with or without paint coating, particularly improved perforation corrosion resistance at joints as well as good weldability, workability, phosphatability and paintability.

Among prior art conventional surface treated steel strips, there are known galvannealed steel strips which satisfy the above requirements to some extent as they possess exceptionally high corrosion resistance after paint coatings. The conventional galvannealed steel is prepared by subjecting steel to zinc hot-dipping followed by a heat treatment to form a Zn-Fe alloy coating having a major proportion of $\delta_1$ phase. Zinc electroplated steel has also been used to form a galvanneal product by an isothermal heat treatment to produce similar results.

Thus, the $\delta_1$ phase structure is usually produced by the hot-dip and annealing process. This material, called $\delta_1$ galvanneal, is known to have the best ductility and corrosion resistance of all the intermetallic structures produced in the Fe-Zn system and consists of 10% $\Gamma$ phase and 90% $\delta$ phase. In the conventional hot-dip galvanneal process, the aim is to alter favorably the ratio of the phase layers present for better coating properties.

Two methods typically used to produce $\delta_1$ galvanneal are:

(1) Heat the Zn coated steel strip immediately after it leaves the galvanizing bath and before the zinc coating has solidified. This structure typically contains 10% $\Gamma$ phase and 90% $\tau_1$ phase.

(2) Heat galvanized steel below the melting point of zinc up to 350°-380° C. for 2-3 hours.

Most galvannealed steel sheets are produced in continuous galvanizing lines using the first method. The galvanneal coatings exhibit good paint adhesion because its surface is relatively uniform and smooth with a finish on a microscale which gives relatively good mechanical keying for painting. The coating has relatively good corrosion resistance after painting and is easier to weld than galvanized coatings. However, the conventional techniques for producing $\delta_1$ galvanneal have been unsuccessful in providing steel strips with such a high degree of strength and workability as is currently required for automobile use. Further, when thinly coated, the conventional galvannealed steel strips do not possess satisfactory local corrosion resistance or perforation corrosion resistance during service at joints like hemmed joints.

In order to eliminate the above-mentioned shortcomings of galvannealed steel while taking advantage of its excellent corrosion resistance with or without paint coating, Zn-Fe alloy electroplating has recently been used as an improvement over the galvannealing as disclosed in Japanese Patent Application Kokai Nos. SHO 54-107838, 57-60087 and 57-200589, and Japanese Patent Publication No. SHO 57-61831, for example. The Zn-Fe alloy electroplating is substantially equivalent to galvannealing in regard to corrosion resistance with or without paint coating, paint adhesion, phosphatability and weldability where the content of iron is in the range of 5% to 30% by weight.

Unfortunately the prior art techniques for producing galvannealed steel sheets have produced products which are not entirely satisfactory. It is believed by the present inventors that one important shortcoming of the prior techniques is that these techniques produce, in addition to $\delta_1$ phase Zn-Fe structure, significant amounts of other Zn-Fe phases, particularly, $\Gamma$ phase, which diminish the corrosion resistance, paint adhesion and weldability of the finished product. The prior art techniques for producing a galvannealed steel sheet from Zn-Fe alloy electrodeposited coatings are only concerned with an isothermal galvannealing process and do not involve an in-line processing technique whereby the electroplated steel is dynamically heated to a predetermined temperature and then cooled to room temperature.

Other prior art references of interest to the background of the present invention are U.S. Pat. No. 4,252,866 and Japanese patent publications 55-37590, 56-13490, 57-19393, 57-19331, 57-89494, 57-164998, 57-200589, 58-117866, 59-23894, 59-200791 and 59-229493.

SUMMARY OF THE INVENTION

Accordingly, one object of the present invention is to provide a new and improved method of producing $\delta_1$ galvanneal which exhibits improved corrosion resistance and paint adhesion and is readily amenable to welding.

Another object of this invention is to provide a novel method for producing $\delta_1$ galvanneal which is virtually 100% composed of $\delta_1$ phase structure, i.e., does not contain $\eta$ phase, $\Gamma_1$ phase, $\zeta$ phase or $\Gamma$ phase structure.

These and other objects are achieved according to the invention by providing a novel method for producing a galvannealed steel sheet in which an Zn-Fe alloy coating is formed on a steel substrate followed by a heat treatment which results in a virtually 100% $\delta_1$ phase galvannealed structure. According to the invention, the steel substrate having the Zn-Fe coating is subjected to a heat treatment including heating the coated steel at a rate between 1° C./min. and 1000° C./min or more, typically between 50° C./min and 1000° C./min, up to a maximum temp. that depend upon iron content, and cooling to room temperature. For example, the original as-plated structure of an 18% Fe-Zn coating, containing $\eta+\delta_1$, transforms to 100% $\delta_1$ phase on heating at 10° C./min between 250°-310° C. Heating above 310° C. allows Fe to diffuse into the coating and causes further transformation to $\Gamma_1$ and $\Gamma$ phase.

The present invention includes the recognition that there exists a stability range for $\delta_1$ phase galvanneal and that heating rate, alloy content of the Zn-Fe coating, and temperature significantly affect the temperature stability of $\delta_1$ phase. According to the present invention, the $\delta_1$ stability range is defined by an empirical relationship linking the process variables of temperature T(° C.), iron content F (wt.%) and heating rate R (°C./min.) to transformation to $\delta_1$ phase. This relationship is given by:

$$a.R^2 + b.T^2 + c.R.F + d.R.T + e.R + f.T = g$$

| Constants | $a*10^8$ | $b*10^9$ | $c*10^6$ | $d*10^7$ | $e*10^5$ | $f*10^6$ | $g*10^4$ |
|---|---|---|---|---|---|---|---|
| Starting $T(T_1)$ | −0.1696 | −0.4120 | −0.1387 | 0.2148 | −0.3774 | 0.3187 | 0.4429 |
| Ending $T(T_2)$ | −31.027 | 11.937 | 11.113 | 10.091 | −52.242 | −9.5511 | −19.057 |

The boundary conditions for iron content F are 5% wt.≦F≦70% wt., and F is preferably selected so that 8% wt.≦F≦21% wt.

In an alternative embodiment, R, T and F are selected and heat treatment performed to heat the Zn-Fe coated steel substrate to a temperature just below the $\delta_1$ stability range, followed by an isothermal hold for a predetermined time period during which transformation to the $\delta_1$ phase occurs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
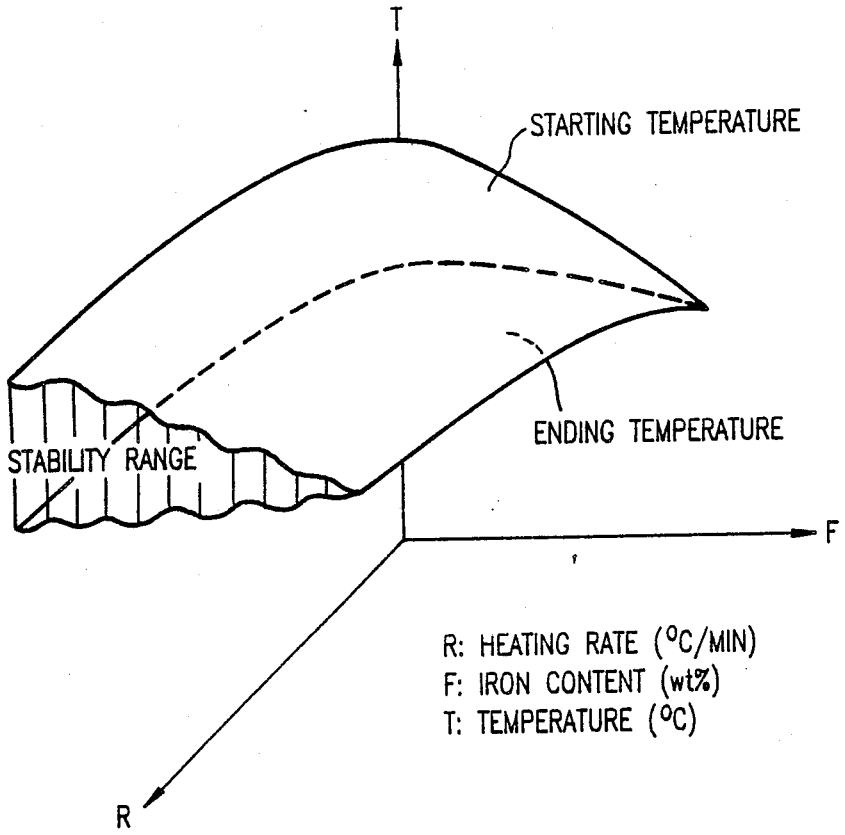
FIG. 1 is a three dimensional graph illustrating the stability range of $\delta_1$ phase as a function of heating rate, iron content and temperature.

Referring now to the drawings, it is seen from the graphs that, according to the discovery of the present invention, the heating rate and alloy content of Zn-Fe coatings significantly affect the temperature stability of $\delta_1$ phase structure. It has been determined according to the invention that stable, substantially 100% $\delta_1$ phase structure results when the heating rate R (°C./min.), iron content F (wt.%) and peak temperature T are chosen to produce galvanneal within the $\delta_1$ stability range, which is graphically shown in FIG. 1.

Thus, for selected values of R and F, the peak temperature of the Zn-Fe coating must fall within lower and upper limits, $T_1$ and $T_2$, wherein F and R are selected so that the following conditions are met, $$1° \text{ C./min} \leqq R \leqq 1000° \text{ C./min},$$

5 wt.% Fe≦F≦21 wt.% Fe, and the upper and lower limits $T_1$ and $T_2$ of the stability range at selected values of R and F are defined by:

$$a_1 \cdot R^2 + b_1 \cdot T_1^2 + c_1 \cdot R \cdot F + d_1 \cdot R \cdot T_1 + e_1 \cdot R + f_1 \cdot T_1 = g_1,$$

$$a_2 \cdot R^2 + b_2 \cdot T_2^2 + c_2 \cdot R \cdot F + d_2 \cdot R \cdot T_2 + e_2 \cdot R + f_2 \cdot T_2 = g_2,$$

where:

| | |
|---|---|
| $a_1 = -0.1696 \times 10^8$, | $a_2 = -31.027 \times 10^8$, |
| $b_1 = -0.4120 \times 10^9$, | $b_2 = 11.937 \times 10^9$, |
| $c_1 = -0.1387 \times 10^6$, | $c_2 = 11.113 \times 10^6$, |
| $d_1 = 0.2148 \times 10^7$, | $d_2 = 10.091 \times 10^7$, |
| $e_1 = -0.3774 \times 10^5$, | $e_2 = -52.242 \times 10^5$, |
| $f_1 = 0.3187 \times 10^6$, | $f_2 = -9.5511 \times 10^6$, |
| $g_1 = 0.4429 \times 10^4$, | $g_2 = -19.057 \times 10^4$. |

Figure 2:
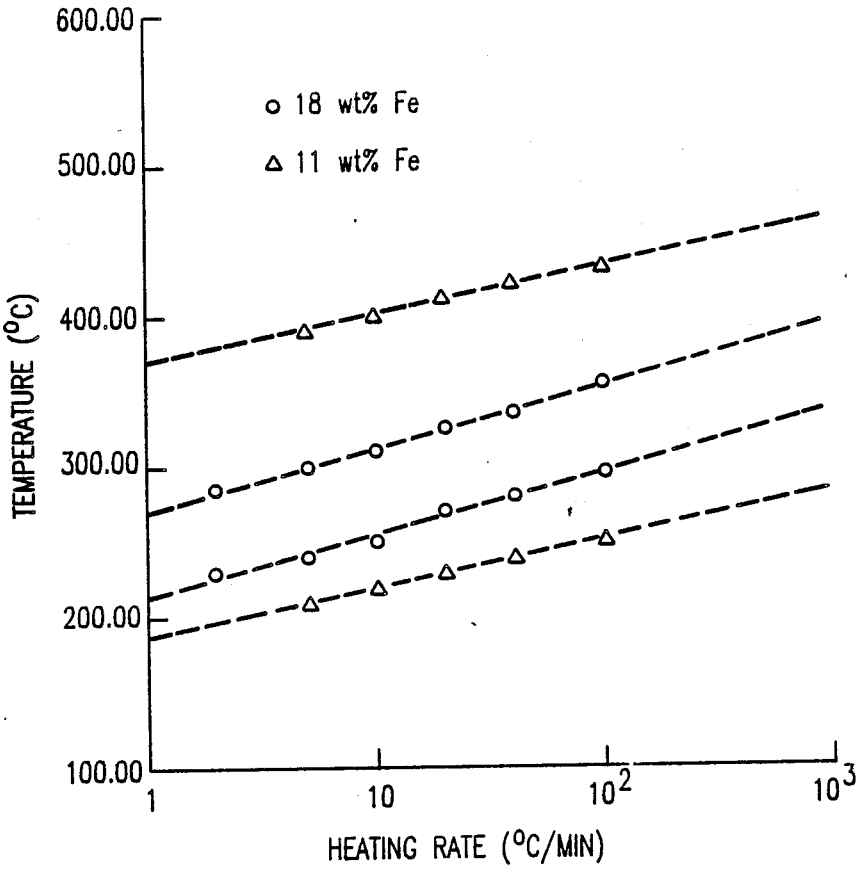
FIG. 2 is a two dimensional graph illustrating the stability range of $\delta_1$ phase as a function of heating rate and temperature for iron contents of 18 wt.% Fe and 11 wt.% Fe.

FIG. 2 illustrates the $\delta_1$ phase stability range for particular Fe contents in the ZnFe alloy of 11 wt.% of Fe and 18 wt.% of Fe. The curves shown in FIG. 2 illustrate the intersection of planes parallel to the R-T plane of FIG. 1 intersecting the F axis of FIG. 1 at 11 wt.% and 18 wt.%. To obtain 100% $\delta_1$ content for a Zn-Fe alloy, temperature treatment of the alloy must occur for the 11 wt.% Fe alloy, between the upper and lower curves intersecting the star data points. Similarly, for the 18 wt.% Fe Zn-Fe alloy, temperature treatment must occur between the upper and lower curves intersecting the circle data points.

Various examples illustrating the product produced by the dynamic heating treatment of the present invention, i.e., heat to temperature at a given rate and quench, as well as heat treatments outside the disclosed $\delta_1$ stability range, are next presented.

| Example | Alloy | Heating Rate | Specimen Temp. | Phases Present |
|---|---|---|---|---|
| 1 | Zn-11% Fe | 10° C./min. | 170° C. | $\eta+\delta_1$ |
| 2 | Zn-11% Fe | 10° C./min. | 220° C. | $\delta_1$ |
| 3 | Zn-11% Fe | 10° C./min. | 270° C. | $\delta_1$ |
| 4 | Zn-11% Fe | 10° C./min. | 360° C. | $\delta_1$ |
| 5 | Zn-11% Fe | 10° C./min. | 400° C. | $\delta_1$ |
| 6 | Zn-11% Fe | 10° C./min. | 450° C. | $\delta_1+\Gamma_1$ |
| 7 | Zn-11% Fe | 10° C./min. | 550° C. | $\delta_1+\Gamma_1+\Gamma$ |
| 8 | Zn-18% Fe | 10° C./min. | 160° C. | $\eta+\delta_1$ |
| 9 | Zn-18% Fe | 10° C./min. | 260° | $\delta_1$ |
| 10 | Zn-18% Fe | 10° C./min. | 340° C. | $\delta_1+\Gamma_1$ |
| 11 | Zn-18% Fe | 10° C./min. | 420° C. | $\delta_1+\Gamma_1$ |
| 12 | Zn-18% Fe | 10° C./min. | 500° C. | $\Gamma_1+\Gamma_1$ |
| 13 | Zn-18% Fe | 10° C./min. | 550° C. | $\Gamma$ |
| 14 | Zn-18% Fe | 100° C./min. | 300° C. | $\delta_1$ |
| 15 | Zn-18% Fe | 100° C./min. | 340° C. | $\delta_1$ |

Consistent with FIG. 2, Examples 2-5, 9, 14 and 15 resulted in virtually 100% $\delta_1$ phase structure. Accordingly, compared to the conventional galvanneal structure obtained from hot dip Zn coatings, which is reported by G. J. Harvey and P. N. Richards, *Metal Forum*, 6-4 (1984) to be 10% $\Gamma$ phase and 90% $\delta_1$ phase, the $\delta_1$ galvanneal from electrogalvanized or electrodeposited Zn-Fe alloys, which have a uniform distribution of Zn and Fe after electrodeposition, produced by the heat treatment according to the present invention is virtually 100%.

The heat treatment of the present invention, performed after the electrogalvanized process, can be accomplished by either (1) batch or box annealing coils in a separate furnace or (2) continuous annealing the coated product in-line after electrodeposition. In the first process, the electrodeposited coating is coiled and moved to a furnace for batch or box annealing. The furnace may heat one coil or a stack of coils. The heating rates in this process are relatively slow as is the cooling rates. Soak time in the furnace can be a variable which is an advantage of this process, if the heat treatment requires an isothermal hold, discussed in more detail below.

The second process, continuous annealing, can be accomplished in many ways. The major criterion for the implementation of an in-line process is to match the line speed of the sheet coming out of the electrode-position cells with the heating rate in the post heat treatment process. Line speeds can be slowed by the introduction of "loopers" to accommodate the change in speed. The major advantage of heating in-line is that little time is lost in processing the product as compared to a batch-type process.

It should be understood that the present invention also encompasses a process including an isothermal hold, and the product thereby formed. Tests performed by the inventors reveal that it is possible to produce virtually 100% $\delta_1$ phase galvanneal by heating at a selected rate until the temperature of the specimen is just below the $\delta_1$ phase stability range, followed by a brief isothermal hold, the time period of which is a function of the wt.% Fe. For example, referring to FIG. 2, heating 11 wt.% Fe specimen at a rate of 10° C./min until the specimen attains a temperature of just under 200° C., i.e., just below the stability range, followed by an isothermal hold time $t_I$, where 0.5 hrs. $<t_I<$ 16 hrs., results in transformation from $\eta+\delta_1$ phase to $\delta_1$ phase.

If $t_I$ is increased to greater than 16 hrs., transformation to $\Delta_1+\Gamma_1$ phase occurs. As evident from FIG. 2, heating 11 wt.% Fe at 10° C./min to a temperature of 300° C. results in $\delta_1$ phase galvanneal. If an isothermal hold for 0.5 hours is then performed, $\delta_1$ phase galvanneal is maintained. However, if an isothermal hold for 16 hrs. is performed, transformation to $\delta_1+\Gamma_1$ phase occurs.

On the other hand, for 18 wt.% Fe heated at 10° C./min to 200° C., i.e., outside the stability range for 18 wt.% Fe shown in FIG. 2, an isothermal hold for 0.5 hrs. has been found to result in transformation from $\eta+\delta_1$ phase to $\delta_1$ phase galvanneal. If $t_I$ is increased to 16 hrs. in this example, transformation to $\delta_1+\Gamma_1$ phase has been found to occur. Further, heating 18 wt.% Fe at 10° C./min to 300° C., i.e., within the stability range of $\delta_1$ phase as shown in FIG. 2, followed by an isothermal hold for time $t_I$=0.5 hrs. has been found to result in transformation to $\delta_1+\Gamma_1$ phase. When $t_I$ was increased to 16 hrs., $\delta_1+\Gamma_1$ phase was still observed. These tests are summarized in the following table.

| | Temp* (°C.) | Isothermal hold time $t_I$ (hours) | Phases Observed |
|---|---|---|---|
| Zn-11 wt. % Fe | 200 | 0.5 | $\eta+\delta_1$ |
| | 200 | 1 | $\delta_1$ |
| | 200 | 16 | $\delta_1$ |
| | 300 | 0 | $\delta_1$ |
| | 300 | 0.5 | $\delta_1$ |
| | 300 | 16 | $\delta_1+\Gamma_1$ |
| Zn-18 wt. % Fe | 200 | 0.5 | $\delta_1$ |
| | 200 | 16 | $\delta_1+\Gamma_1$ |
| | 300 | 0 | $\delta_1$ |
| | 300 | 0.5 | $\delta_1+\Gamma_1$ |
| | 300 | 16 | $\delta_1+\Gamma_1$ |

*Specimen heat at 10° C./min to temperature listed.

Thus, the tests performed by the inventors indicate that there is a very narrow temperature versus time $t_I$ as a function of wt.% Fe stability range for the $\delta_1$ phase. In other words, an isothermal hold has the effect of slightly lowering the lower stability range curves of FIG. 2.

Heating can be accomplished by several methods. The fastest heating rates are obtained using induction heating or even laser heating, whereas slow rates are obtained by using standard oil, gas or electric furnaces. Presently, induction heating as well as standard furnaces are being used to galvanneal a hot-dip product. Although the usual method of induction heating is by the implementation of a long high frequency induction coil, called longitudinal flux heating, the use of a short low-frequency inductor can be used called transverse flux heating. The latter method is far more efficient for this material than conventional longitudinal flux heating. Lasers can be indexed to scan the entire coil horizontally as the sheet passes by, also giving a very high heating and cooling rate.

The present invention allows for the placement of an in-line furnace to galvanneal electroplated Zn-Fe alloy coatings at a much lower temperature and with greater process control on heating rate and cooling rate. With the large economic impact that electroplated coatings are now having in the world-wide automobile market, this process of the present invention offers a tremendous potential for improved coating properties.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A method for producing a galvanneal layer on a steel substrate, comprising:

forming a Zn-Fe alloy coating having a uniform distribution of Zn and Fe and an Fe content F (wt.%) on said steel substrate; and heat treating said Zn-Fe coating on said substrate at a heating rate R (°C./min) so that said coating attains a peak temperature between a first temperature $T_1$ and a second temperature $T_2$ which are respectively lower and upper limits of an empirically determined stability range for producing substantially 100% $\delta_1$ phase Zn-Fe, wherein F and R are selected so that the following conditions are met, $$1° \text{ C./min} \leqq R \leqq 1000° \text{ C./min},$$

5 wt.% Fe≦F≦21 wt.% Fe, and said upper and lower limits $T_1$ and $T_2$ of said stability range at selected values of R and F are defined by:

$$a_1 \cdot R^2 + b_1 \cdot T_1^2 + c_1 \cdot R \cdot F + d_1 \cdot RR \cdot T_1 + e_1 \cdot R + f_1 \cdot f_1 \cdot T_1 = g_1,$$

$$a_2 \cdot R^2 + b_2 \cdot T_2^2 + c_2 \cdot R \cdot F + d_2 \cdot R \cdot T_2 + e_2 \cdot R + f_2 \cdot T_2 = g_2,$$

where:

| | |
|---|---|
| $a_1 = -0.1696 \times 10^8$, | $a_2 = -31.027 \times 10^8$, |
| $b_1 = -0.4120 \times 10^9$, | $b_2 = 11.937 \times 10^9$, |
| $c_1 = -0.1387 \times 10^6$, | $c_2 = 11.113 \times 10^6$, |
| $d_1 = 0.2148 \times 10^7$, | $d_2 = 10.091 \times 10^7$, |
| $e_1 = -0.3774 \times 10^5$, | $e_2 = -52.242 \times 10^5$, |
| $f_1 = 0.3187 \times 10^6$, | $f_2 = -9.5511 \times 10^6$, |
| $g_1 = 0.4429 \times 10^4$, | $g_2 = -19.057 \times 10^4$. |

2. The method according to claim 1, wherein said step of forming said Zn-Fe coating comprises an electroplating process.

3. The method according to claim 1, wherein said heat treating step comprises induction heating of the coated steel substrate.

4. The method according to claim 1, wherein said heat treating step comprises laser heating of the coated steel substrate.

5. The method according to claim 1 wherein said predetermined heating rate R is selected so that 50° C./min.≦R≦1000° C./min.

6. The method according to claim 1, wherein said iron content F is selected so that 8 wt.% Fe≦F≦21 wt.% Fe.

7. A method for producing a galvanneal layer on a steel substrate, comprising:

forming a Zn-Fe alloy coating having a uniform distribution of Zn and Fe and an Fe content F (wt.% Fe) on said steel substrate;

heat treating said Zn-Fe coating on said substrate at a heating rate R (°C./min.) to a temperature T just below a temperature $T_1$(°C.) which defines a lower limit of an empirically determined stability range for $\delta_1$ phase galvanneal, wherein F and R are selected so that the following conditions are met, 1° C./min≦R≦1000° C./min, 5 wt.% Fe≦F≦21 wt.% Fe, and the lower limit $T_1$ of said stability range at selected values of R and F is defined by:

$$a_1 \cdot R^2 + b_1 \cdot T_1^2 + c_1 \cdot R \cdot F + d_1 \cdot R \cdot T_1 + e_1 \cdot R + f_1 \cdot T_1 = g_1,$$

where:

| |
|---|
| $a_1 = -0.1696 \times 10^8$, |
| $b_1 = -0.4120 \times 10^9$, |
| $c_1 = -0.1387 \times 10^6$, |
| $d_1 = 0.2148 \times 10^7$, |
| $e_1 = -0.3774 \times 10^5$, |
| $f_1 = 0.3187 \times 10^6$, |
| $g_1 = 0.4429 \times 10^4$; |

and maintaining said Zn-Fe coating on said substrate at said temperature T for a time period $t_I$ until substantially 100% $\Delta_1$ phase galvanneal is produced.

8. The method according to claim 7, wherein said step of forming said Zn-Fe coating comprises an electroplating process.

9. The method according to claim 7, wherein said heat treating step comprises induction heating of the coated steel substrate.

10. The method according to claim 7, wherein said heat treating step comprises laser heating of the coated steel substrate.

11. The method according to claim 7, wherein said predetermined heating rate R is selected so that 50° C./min≦R≦1000° C./min.

12. The method according to claim 7, wherein said iron content F is selected so that 8 wt.% Fe≦F≦21 wt.% Fe.

13. The method according to claim 7, wherein R=10° C./min, F=11 wt.% Fe, T=200° C. and 0.5 hours $<t_I<$16 hours.

14. The method according to claim 7, wherein R=10° C./min, F=18 wt.% Fe, T=200° C. and 0$<t_I<$0.5 hours.

* * * * *